United States Patent [19]

Van Eek, deceased

[11] 4,278,137

[45] Jul. 14, 1981

[54] APPARATUS FOR EXTRACTING MINERALS THROUGH A BOREHOLE

[75] Inventor: Wouter Van Eek, deceased, late of Wassenaar, Netherlands, by Meryl A. M. Van Eek nee Beckett, legal representative

[73] Assignee: Stamicarbon, B.V., Geleen, Netherlands

[21] Appl. No.: 49,407

[22] Filed: Jun. 18, 1979

[30] Foreign Application Priority Data

Jun. 19, 1978 [NL] Netherlands ..... 7806559

[51] Int. Cl.[3] ..... E21B 9/26

[52] U.S. Cl. ..... 175/267; 175/284; 299/17; 299/34

[58] Field of Search ..... 407/13; 175/285, 284, 175/272, 267; 299/18, 17, 34; 15/104.17, 104.19

[56] References Cited

U.S. PATENT DOCUMENTS

| | | | |
|---|---|---|---|
| 2,450,223 | 9/1948 | Barbour | 175/267 |
| 2,690,325 | 9/1954 | Dismukes | 175/263 X |
| 2,847,189 | 8/1958 | Shook | 175/267 |

FOREIGN PATENT DOCUMENTS 2321962 5/1974 Fed. Rep. of Germany .

*Primary Examiner*—William F. Pate, III

*Attorney, Agent, or Firm*—Cushman, Darby & Cushman

[57] ABSTRACT

An apparatus consisting of pipe sections pivotally joined which can be insert in a borehole when in straight position and manipulated to a zigzag position to loosen minerals outside the wall of the borehole.

12 Claims, 5 Drawing Figures

APPARATUS FOR EXTRACTING MINERALS THROUGH A BOREHOLE

The invention relates to apparatus for extracting minerals through a borehole, this apparatus consisting substantially of a number of sections connected to a pipe string and pivotally jointed to each other, which, in straight position, can be inserted in the hole already drilled into the mineral deposit, and of means for subsequently disposing the sections in zigzag position and reciprocating them, with, near the joints of the sections, means capable of loosening the mineral outside the wall of the borehole so that it can be removed through this borehole with the aid of a flushing liquid.

U.S. Pat. No. 3,961,824 describes a process employing apparatus of this kind. However, under certain conditions met with in practice this apparatus is not sufficiently stable. It is not always possible to distribute the forces evenly over the joints, nor to make all joints turn through the same angle. In addition, the cable used to dispose the sections in zigzag position is liable to get damaged. Also, the use of the cable leads to a complicated construction.

Therefore, the object of the present invention is to provide a more efficient embodiment for apparatus as described above. According to the invention this is achieved if the pivotally jointed sections, when in the straight position, are contained within a sleeve fitting inside the borehole, this sleeve being provided with one or more lateral slots through which the sections can project outside the sleeve so as to be disposed in a zigzag by means cooperating with the sleeve that are capable of exerting an axial force on the extreme sections.

In one embodiment of the invention three sections are contained within the sleeve in the straight position. The sleeve is here provided with lateral slots on opposite sides, through which slots the sections may zigzag out in opposite directions. The middle one of these sections is connected to the sleeve by means of a pivot that can move along the axis of the sleeve, so that the sections will always project equally far on either side. The slots may be made so long as to allow the middle section to take up a position almost normal to the sleeve.

Preferably, the sleeve will be a tube of such diameter that it can easily be inserted up to the end of the borehole, even if the hole is deviated. The sections have such a length that in zigzag position they extend over a width that is a multiple of the diameter of the sleeve. This width may vary from a few times the sleeve diameter up to 20 meters or even more, depending on what may be required.

The means for loosening the mineral may be bits provided at the joints of the sections. As a flushing liquid is needed to remove the loosened mineral through the borehole, preferably nozzles for liquid are provided at the joints, to loosen the mineral by means of a jet action. Coal, for instance, can farily easily be loosened by means of jets of liquid.

Consequently, the invention is further characterized in that the means for loosening the mineral consist of nozzles spurting jets of liquid away from the sleeve, which nozzles are situated close to the joints or right on the joints of the sections. In the most obvious design, the liquid is passed to the nozzles through the sections, which are made hollow. Preferably, the liquid should not be passed through the pivoting joints, as this would require a complicated construction, so that the passage could easily get blocked. Preferably, the joints are completely closed ball- and socket joints. In order that the liquid flowing through the sections may be passed around the joints, use is made for instance of flexible high-pressure tubing. The tubing is laid to the inside of the joints, so that it is not easily damaged. Because the cavities formed in the mineral deposit will usually be less high than the borehole, the sleeve remains fixed in the original borehole. It may happen that so much mineral is removed that the sleeve is no longer stably positioned in the cavity formed. The reaction forces of the nozzles act in such a direction that the resultant couple of forces acting on the apparatus is then insufficiently absorbed. Therefore, it is sometimes preferable for the sleeve in the borehole to contain only two sections, and to have only one lateral slot, through which the two sections can project outside the sleeve. In this case only one nozzle or one set of nozzles is used, and a cavity is made on only one side of the borehole. The sleeve in its entirety rests against the non-affected wall of the borehole. Undesirable reaction forces may also be absorbed in other ways, e.g. by means of a guid placed in the borehole.

The means cooperating with the sleeve that are capable of exerting an axial force on the extreme sections consist of a hydraulically operated plunger which, through a pivot, exerts an axial force on the section closest to the pipe string, with the final section, the one away from the pipe string, resting pivotally on the end of the sleeve.

It is necessary for the length over which the sections project to be controllable. This is achieved in a simple way be sealing the plunger against a bush which cooperates by means of screw thread with the lower part of the pipe string, the screw thread of this bush turning in the opposite direction to that of the pipe string connections, and the bush being capable of turning in relation to the sleeve and the sections, with a stop on the bush limiting the stroke of the plunger relative to the bush. Of course, the plunger must be hollow, in order that liquid may pass from the pipe string to the sections. The hydraulic pressure acting on the plunger moves it towards the sections, extering an axial pressure on them. The result is that the sections will deflect sideways. However, the stroke of the plunger is limited by the stop on the bush. When, on account of the drill string being rotated, the bush is moved in the axial direction, the stop is taken along and the angle through which the sections are deflected is changed.

Creation of the cavities in the mineral deposit is effected by the action of the water jets, and by the drill string being mechanically moved up and down at the surface. As a result, the sleeve connected to the string, and the deflected sections, will reciprocate in the mineral deposit, and the water jets from longitudinal cavities on both sides of the borehole (or, in some cases, on one side, as explained above).

Briefly stated, the principal element of the invention distinguishing it from what is known form U.S. Pat. No. 3,961,824, is the use of the sleeve in a multiple function, viz.:

1. keeping the deflectable sections exactly in line and reducing the forces exerted on the movable joints;
2. transmitting the axial force needed to deflect the sections;
3. providing the possibility to limit the deflection;
4. keeping the apparatus correctly disposed during operation;

5. providing the possibility of making a long-stroke reciprocating movement with the use of simple equipment.

As to the last point, it should be added that instead of moving the pipe string up and down at the surface—which rather limits the length of the stroke—it is also possible to effect the axial movement by the use of a hydraulic cylinder. Part of the pipe string—preferably the part cooperating with the bush mentioned above—is then designed as a hydraulic cylinder, i.e. part of the pipe string constitutes the cylinder wall, and the part cooperating with the bush forms the plunger, sufficient room being left to allow the sections to pass. By alternately raising and lowering the pressure of the liquid in the annular space between the wall of the borehole and the pipe string, and simultaneously lowering and raising the pressure of the liquid in the pipe string itself, the plunger, and hence the bush and the sleeve, can be reciprocated over a distance equalling the effective length of the cylinder. There is no objection to making this a great length, e.g. in the order of some tens of meters.

The invention will be elucidated with reference to a drawing, in which

Figure 1:
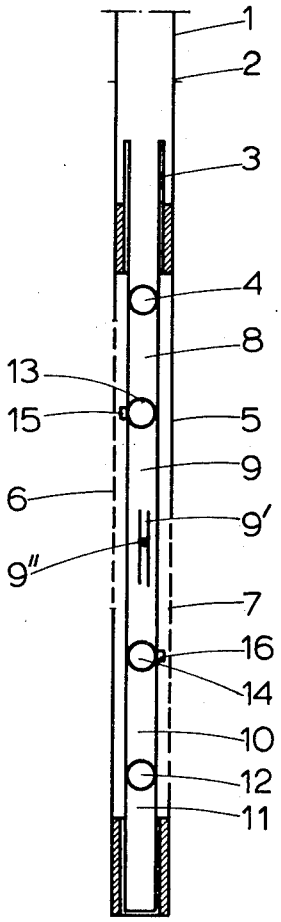
FIG. 1 is a sectional view of the sleeve in which the sections with the nozzles are contained in the straight position (not deflected)

FIG. 1 shows a pipe string 1 in a borehole (not drawn). The bottom part 2 comprises a controllable hydraulically operated pressure device with a plunger 3, which device will be described in more detail with reference to FIG. 3. The pressure device of part 2 is pivotally jointed, at 4, to the tubular sleeve 5, which constitutes the frame of the winning device. This sleeve 5 has lateral slots 6 and 7, which are opposite each other and staggered along the length of the sleeve 5. Through these slots 6 and 7 the three sections 8, 9 and 10 can be deflected outside the sleeve. The length of the sections 8 and 10 is—in this embodiment—about half of the length of section 9. Section 9 has pivots 9″ that can move in the fixed axial guide 9′, which pivots are formed by pins on either side of the section 9. These keep the centre point of that section fixed in relation to the sleeve 5. Section 8 is pivotally jointed, at 4, to plunger 3; section 10 is pivotally supported, at 12, on a terminal piece 11 of sleeve 5, and sections 8, 9 and 10 are pivotally jointed to each other at 13 and 14. At or near the joints 13 and 14 nozzles or sets of nozzles 15 and 16 are placed in such a position that the liquid jet or jet components leave the nozzles in a direction as nearly normal to sleeve 5 as possible.

The sleeve 5 and all parts pertaining to it are lowered into the borehole by means of pipe string 1, as far as the place where mineral material (e.g. coal) is to be extracted. Sections 8, 9 and 10 are then contained in the sleeve 5 in the straight position, as shown by FIG. 1. Through pipe string 1, plunger 3 and section 8 and 9, liquid under high pressure is now supplied to nozzles 15 and 16. At the same time, sleeve 5 is reciprocated on account of the string 1 being moved up and down. The jet action of the liquid leaving the nozzles 15 and 16 loosens material from the wall of the borehole, so that shallow longitudinal cavities are formed on either side of the borehole. Now, the sections 8, 9 and 10 are brought into the zigzag position shown in FIG. 2, by suitable control of the pressure device and by the action of plunger 3. The sections then already project partly into the cavities formed. Now the cavities are deepened by again loosening material by means of liquid jets and at the same time reciprocating sleeve 5. This operation is repeated until section 9 is at a fairly wide angle to the sleeve; the maximum cavity depth has now been reached. The length of the cavity is determind by the stroke of the sleeve 5 and depends on the possibilities offered by the mechanism used for reciprocating pipe string 1. The loosened material is removed, together with the liquid supplied by nozzles 15 and 16, through the annular passage in the borehole.

Figure 3:
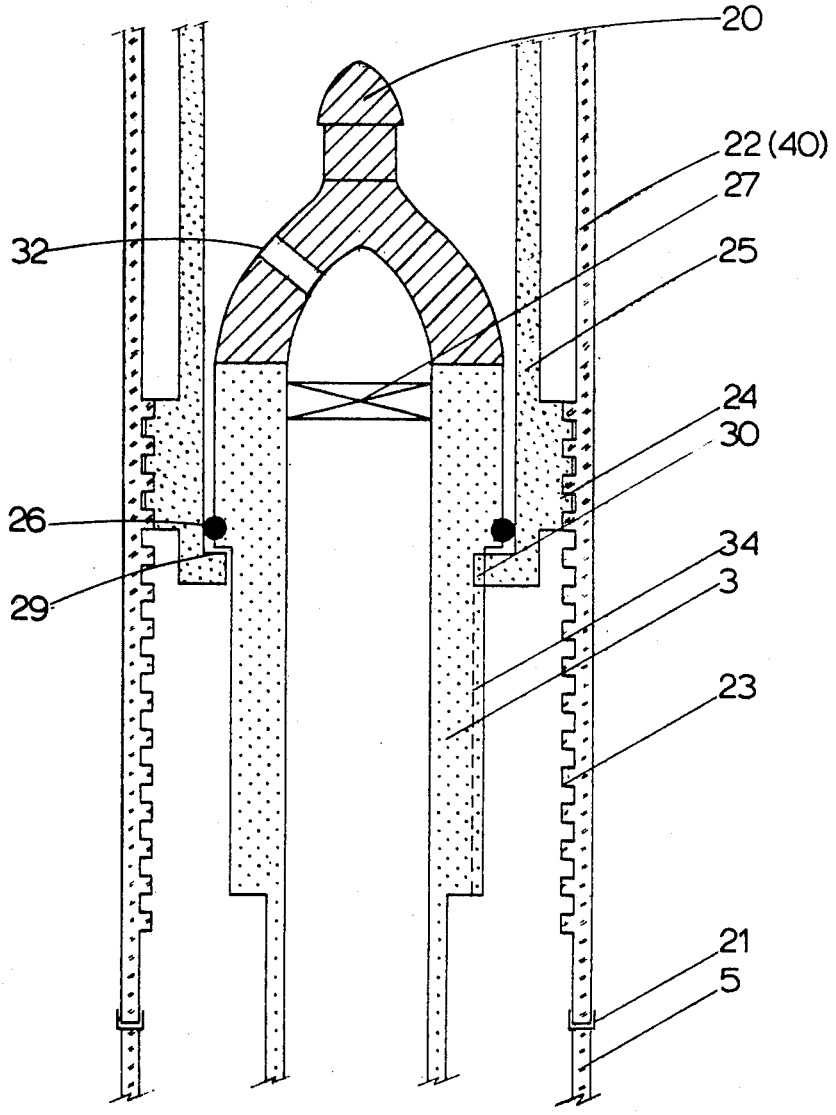
FIG. 3 is a lengthwise sectional view of the hydraulically operated pressure device.

Sections 8, 9 and 10 can be removed integrally. To this end use is made of the grip head 20 on plunger 3—which is shown in FIG. 3—, by which the deflectable part can in its entirety be removed by the use of a collecting device (inserted through the pipe string) with a cable. This is done in the same way as in which recoverable core barrels are pulled out without removal of the rotary drill string from the borehole.

Figure 2:
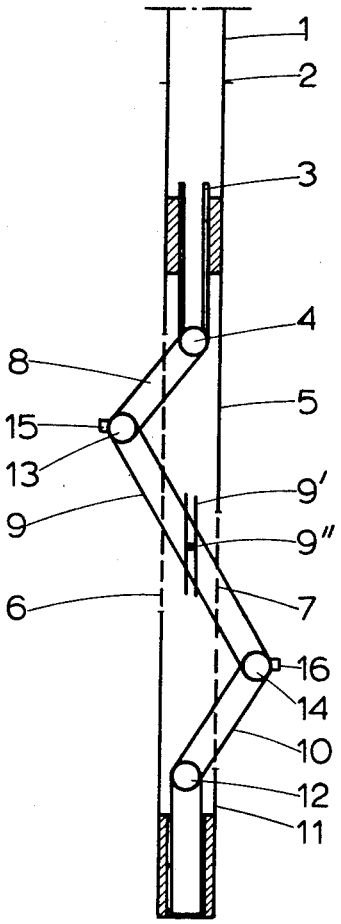
FIG. 2 is a sectional view of the same, with the sections in zigzag position (deflected)

FIG. 3 shows how the controllable hydraulic pressure device for the deflectable sections 8, 9 and 10 may be designed. At 21, the sleeve 5 is rotatably connected to the bottom part 22 of the drill string 1 or another part taking its place (40). The bottom part 22 is internally provided with left-handed screw thread 23 of large pitch, which cooperates with corresponding screw thread 24 of the bush 25. In bush 25 plunger 3 can now move in the axial direction, this plunger being sealed against the bush by means of one or more O-rings 26. Plunger 3 is pivotally jointed to the deflectable section 8, as shown in FIGS. 1 and 2. If through drill string 1 liquid pressure is applied to plunger 3 (with the overpressure valve 27 still closed), the plunger will move towards the sections 8, 9 and 10, making them deflect. The deflection continues until shoulder 28 of plunger 3 is stopped by the edge 29 of bush 25. The rising liquid pressure will now open valve 27, so that liquid can pass through plunger 3 and sections 8 and 9 to nozzles 15 and 16. Thereafter the entire apparatus is reciprocated, so that the cavities mentioned earlier are formed or are further deepened.

In order now to make sections 8, 9 and 10 deflect further, drill string 1, and hence also part 22, is turned clockwise. The bush 25 cannot follow this movement. The plunger is pivotally jointed to sections 8, 9 and 10, so that it can move in one plane only. These sections are fixed in the cavities formed outside the borehole, so that the plunger 3 cannot turn either. The key 30 of bush 25, which cooperates with plunger 3 by means of a keyway 31 provided in this plunger, prevents the bush 25 from turning, too. The result of the rotation of the drill string 1 is that the bush is moved towards sleeve 5. The stop 29 follows this movement, so that the plunger can move further towards sleeve 5, allowing the sections 8, 9 and 10 to deflect further.

The plunger 3 is provided with a grip head 20, by which the whole of plunger and sections can be removed from the borehole in the manner already mentioned. The grip head has a passage 32 for liquid.

Figure 4:
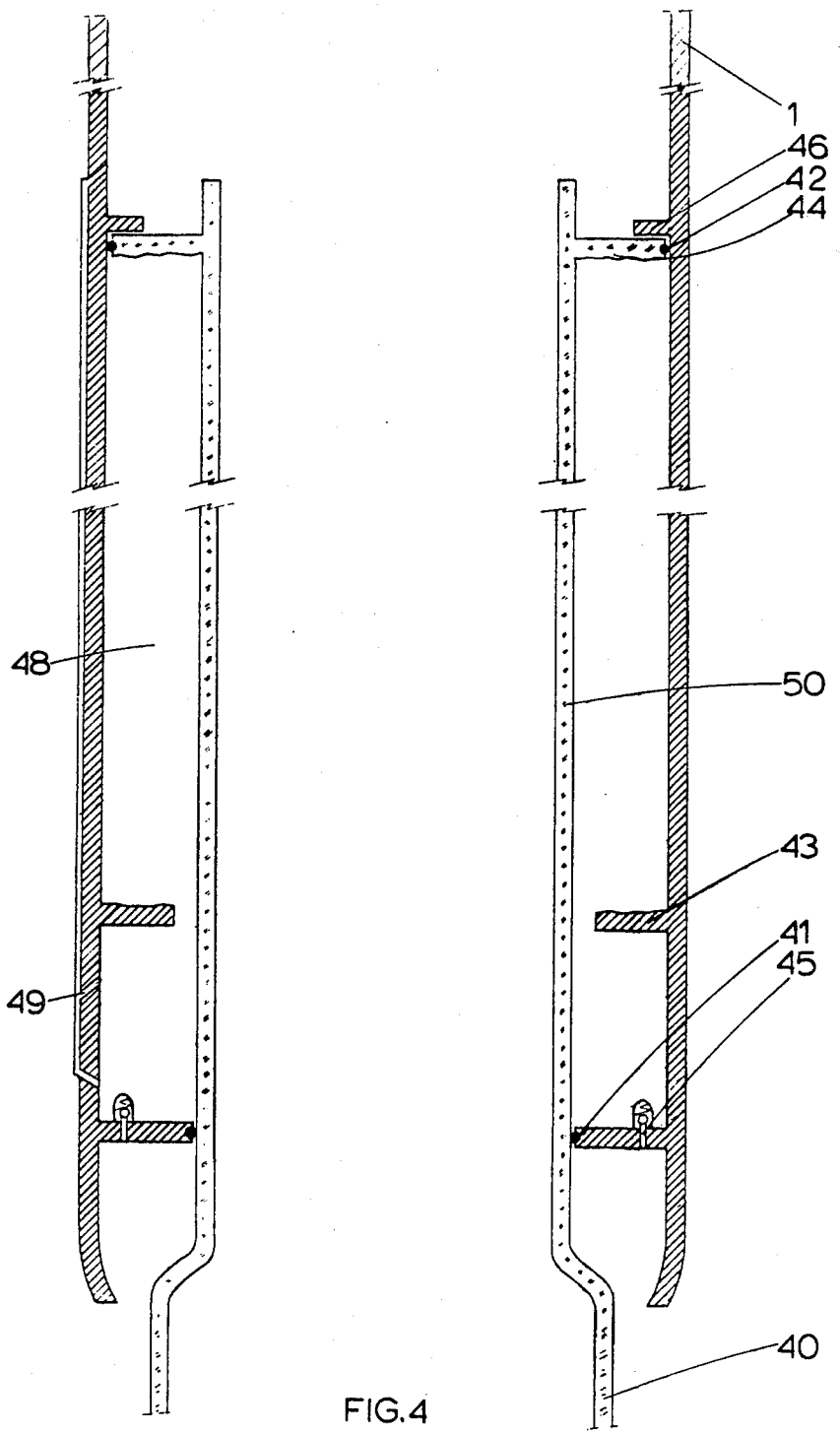
FIG. 4 is a lengthwise sectional view of the device reciprocating the sections.

The sleeve 5 is reciprocated by mechanically moving up and down the pipe string 1 at the surface by means of a winch. This axial movement can be better effected by means of a hydraulic cylinder contained in the borehole. The mechanism needed is shown in FIG. 4. The part 40 of pipe string 1 is no longer connected direct to the rest of the pipe string, but is placed within this string. Now, the annular space 48 between O-rings 41 and 42 can act as a hollow hydraulic cylinder. The winning device, consisting of the part 40, the sleeve 5, the bush 25, the plunger 3 and the sections 8, 9 and 10, are supported on the bottom stop 43 by means of stop 44. Raising the pressure in the annular space results in opening of the non-return valve 45. The entering liquid will now force the entire winning device upward until it reaches stop 46. Thereafter, raising the pressure in pipe string 1—during the "jet action" of the deflected sections—will cause the entire device to move in the opposite direction. The liquid will slowly leave space 48 through narrow channels 49, until the piston 50 is arrested by stops 44 and 46. On account of the pressure and the friction between the two stops, the part 40 together with the pipe string 1 can be turned, which, as said earlier, allows the sections 8, 9 and 10 to be deflected further. The space 48, which has been emptied on account of the pressure exerted, can be filled again if the pressure in the pipe string is released and the pressure in the annular space raised again, which first makes the deflectable sections take up their straight position again and next compresses the spring of valve 45 sufficiently to open this valve and again admit liquid to space 48. This starting position has been described above.

Figure 5:
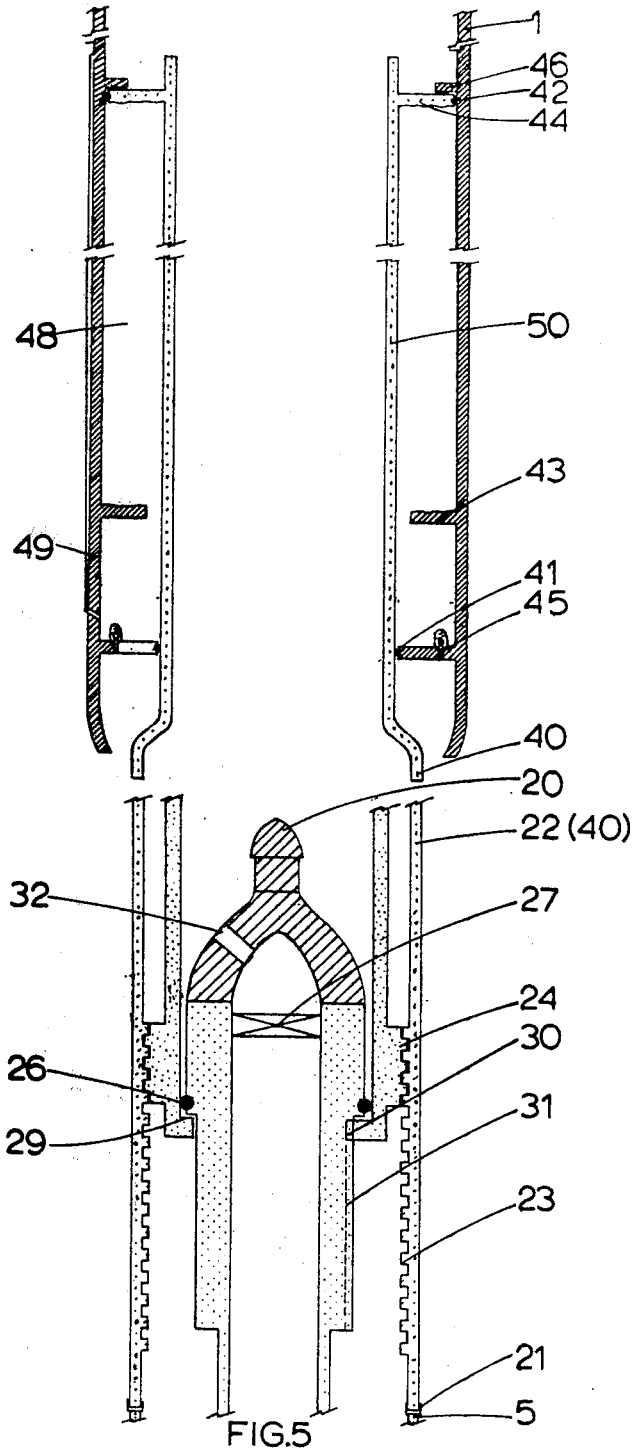
FIG. 5 is a sectional view of the apparatus as a whole.

The mechanism providing the movement is integral with the winning device, as shown in FIG. 5. Although above mention has been made only of the jet action of a liquid for loosening the mineral, the use, or co-use, of bits is by no means excluded. Finally it should be added that, as a matter of course, means are provided for orienting the position of the slots in the sleeve wall. For this purpose use may be made of means and constructions employed in the oil industry.

Example of operating the extraction device

From the surface a 56 cm borehole is made by means of an inclined derrick, in a given strike and at an angle of 30° C. When the hole has reached a depth of 230 meters, a 40.6 cm conductor is brought in and secured in place by means of concrete. In the same strike a 37.5 cm hole is drilled, the slope of this hole being increased by 2 degrees every 30 meters, with the use of modern deviation equipment. At a depth of 600 m below the surface and at 700 m from the mouth of the borehole, measured horizontally, the deviation of the borehole is 80 degrees. At this depth a 1-m thick coal seam is struck which, having a dip of about 10 degrees, extends in the same strike as the borehole. Now a 27.3 cm lining tube is secured in place with concrete, and drilling is continued along the dip of the coal seam. To follow the coal seam, use may be made, for instance, of a 24.8 cm bit equipped with nozzles, to cover a distance of, say, 1000 meters. As, in general, coal is easier to remove by means of liquid jets than the underlying rock, the bit will tend to follow the coal seam. If faults are encountered, it will in most cases be possible to find back the seam by means of deviation equipment of a known type.

Now a 21.9 cm guide tube is inserted, by means of 11.4 cm internal-flush rotary-drill pipes, up to the end of the 1000-m long winning hole. It is assumed that a 20-m wide cavity is to be made in the mineral deposit. The cavity is initiated and widened by means of several specimens of the apparatus according to the invention, with sections of increasing length. In this numerical example only the last stage will be considered, in which the cavity is widened from 10 m to 20 m. The external diameter of sleeve 5 is 14 cm, except in cylinder 50, where it is 11.4 cm. The pipe string 1, which is connected to the 11.4 m rotary-drill pipes, consists of 17.8 cm "extreme line" lining tube. If the deflectable sections 8, 9 and 10 can form a maximum angle of 60° to each other, the length of the longer defectable section is 23 meters, and that of the shorter deflectable sections 11.50 meters.

The nozzles are fixed by means of attachments placed on the deflectable sections as close as possible to each of the two outwardmoving joints of the sections. Each attachment bears seven nozzles of 3 mm diameter each, arranged in an arc. If the drop in liquid pressure is 20 MPa, a reaction force of 970 N will be generated. On account of the nozzles being arranged in an arc, the effective reaction force will be three quarters of 970 N, i.e. 735 N each. The nozzles are so arranged in the attachment that they can approach the wall of coal as closely as possible. To effect a pressure drop of 20 MPa, water is circulated at the rate of 1.1 cu.m per minute.

The hydraulic power output of the nozzles applied to the coal wall is about 365 Kilowatt. The pressure drop is about 1.0 MPa in the roary-drill pipe and 0.05 MPa in the annular space. The turbulent flow in the annular space can carry up pieces of coal up to 2 cm in diameter, so that carrying off the material loosened by the jet action need not cause any problem. The power required is carried to the place where it is to be applied by the liquid, not by a cable as in the case described in the U.S. patent mentioned earlier. The figure mentioned corresponds to the power output required in usual coal-mining processes.

The forces exerted on the sections can be calculated if the coefficient of the frictional resistance between coal seam and scraper sections is known. This may be, say, 0.4. If, on account of the 10° dip, the weight of the apparatus helps in overcoming the friction, it is possible to calculate if the sections are exposed to tension or compression. It is found that, at the start of the operation—i.e. when the cavity is 10 m wide—the bottom section is exposed to a compressive force of 755 N. When the cavity has become 20 m wide, the compressive force exerted on this section is 176 N. As an 11.50-m long section can stand a compressive force of up to 20.6 kN without buckling, these compressive forces are fully allowable. When the cavity is 10 m wide, the second, longer, deflectable section is exposed to a compressive force of 1167 N. When the cavity has become 20 m wide, the compressive force exerted on this section is 814 N. Finally, the top section is subjected to a compressive force of 1285 N when the cavity is 10 m wide, and to 471 N when the cavity is 20 m wide. However, the coefficient of friction can also be lowered, for instance by making use of a zinc coating on the deflectable steel sections, or by using plastics or other means lowering the coefficient of friction. An added advantage is that this will tend to reduce the rate of wear of the deflectable sections.

It has also been determined how fast the pressure cylinder will move the scraper back. If an overpressure of 20 MPa is assumed to be exerted on the scraper, the pressure in the pressure cylinder will be just above 40 MPa. If now there are three outlets (49), each having a diameter of 1.2 mm, the apparatus will move along the coal wall at the rate of 10 cm per sec. If the cylinder is 18 m long, the scraper will cover this length of 18 m in 3 minutes. Returning the scraper can be effected by creating an overpressure of 1–2 MPa in the annular space.

Finally, it should be remarked that for the winning of coal preference will be given to a pressure drop across the nozzles in the order of 20 MPa. The effective distance can then be between 4 and 12 times the diameter of the nozzles.

It is claimed:

1. Apparatus for extracting minerals through a bore hole comprising a sleeve which is provided with one or more longitudinal slots and a chain of pivotally connected sections, one of the outer ends of said chain being pivotally connected to said sleeve, the other outer end of said chain being pivotally connected to an element that can move along the axis of said sleeve, said chain of sections being fastened in each pivot joint between two sections to means capable of loosening the mineral outside the wall of the bore hole and said chain of sections also being fastened in the middle of each section except the first and last section to means which allow a rotation in the plane of the longitudinal slots and an axial movement of the sections along two opposite longitudinal grooves in the sleeve wherein said chain of sections, when in straight position, is within the sleeve and, when in folded state, projects outwardly through the longitudinal slots in the sleeve, said sleeve being connected to a pipe string by means capable of reciprocating the sleeve in the direction of its longitudinal axis, relative to the pipe string, while the pipe string rests in a stationary position.

2. Apparatus according to claim 1, in which said sleeve is connected to said pipe string by means of a double acting hydraulic cylinder and plunger assembly.

3. Apparatus according to claim 1 or 2, in which one outer end of said sleeve is shaped as a plunger and an outer end of said pipe string is shaped as a cylinder, wherein said plunger fits in said cylinder, and with means for activating said plunger.

4. Apparatus according to claim 3 comprising control means adapted to limit the amount of folding of the chain of sections to each possible position between the two extremes, which means can be operated from the earth surface.

5. Apparatus according to claim 1 wherein said means capable of loosening the mineral outside the wall of the bore hole are liquid jets directed away from the sleeve.

6. Apparatus according to claim 5 wherein the sections are hollow and so connected as to allow the passage of liquid fom one section to another.

7. Apparatus according to claim 1 wherein said element consists of a hydraulically operated plunger which through a pivot exerts an axial force on the section closest to the pipe string, with the other end section resting pivotally on the end of the sleeve.

8. Apparatus according to claim 7 wherein said hydraulically operated plunger is sealed against a bush which cooperates by means of a screw thread with the lower part of the pipe string, said screw thread turning in the opposite direction to that of the pipe string connections, and said bush being capable of turning in relation to the sleeve and the sections, with a stop on the bush limiting the stroke of the plunger relative to said bush.

9. Apparatus according to claim 3 wherein said means for activating the plunger comprise means for alternatively raising relative to each other the liquid pressure in the pipe string and the liquid pressure in the annular space between the pipe string and the wall of the borehole, with further means being provided for admitting the liquid into the space in the cylinder and withdrawing the liquid from said space.

10. Apparatus according to claim 1, wherein the sleeve is a tube.

11. Apparatus according to claim 1, wherein the sections except the first and the last ones are of such length that in folded position they extend over a width that is multiple of the diameter of the sleeve.

12. Apparatus for extracting minerals through a bore hole comprising a sleeve which is provided with one longitudinal slot and two pivotally connected sections, the outer end of one section being pivotally connected to said sleeve, the outer end of the other section being pivotally connected to an element that can move along the axis of said sleeve, said sections being fastened in the pivot joint between the two sections to means capable of loosening the mineral outside the wall of the borehole, wherein said sections, when in straight position, are within the sleeve and, when in folded state, project outwardly through the longitudinal slots in the sleeve, said sleeve being connected to a pipe string by means capable of reciprocating the sleeve in the direction of its longitudinal axis, relative to the pipe string, while the pipe string rests in a stationary position.

* * * * *